US010710828B2

(12) United States Patent
Yamauchi et al.

(10) Patent No.: US 10,710,828 B2
(45) Date of Patent: Jul. 14, 2020

(54) SHEET FEEDING APPARATUS AND IMAGE FORMING APPARATUS

(71) Applicant: CANON KABUSHIKI KAISHA, Tokyo (JP)

(72) Inventors: Daigo Yamauchi, Yokohama (JP); Fumiya Sawashima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/982,267

(22) Filed: May 17, 2018

(65) Prior Publication Data

US 2018/0339873 A1 Nov. 29, 2018

(30) Foreign Application Priority Data

May 24, 2017 (JP) ..... 2017-103017

(51) Int. Cl.

| | |
|---|---|
| ***B65H 7/04*** | (2006.01) |
| ***G03G 15/00*** | (2006.01) |
| ***B65H 3/06*** | (2006.01) |
| ***B65H 3/52*** | (2006.01) |
| ***B65H 1/04*** | (2006.01) |
| *B65H 3/56* | (2006.01) |

(52) U.S. Cl.

CPC ..... *B65H 7/04* (2013.01); *B65H 1/04* (2013.01); *B65H 3/06* (2013.01); *B65H 3/5215* (2013.01); *G03G 15/6511* (2013.01); *B65H 3/565* (2013.01); *B65H 2405/1136* (2013.01); *B65H 2553/612* (2013.01)

(58) Field of Classification Search

CPC ... B65H 1/04; B65H 7/04; B65H 3/56; B65H 2405/1136; B65H 2405/11162; B65H 3/565

See application file for complete search history.

(56) References Cited

U.S. PATENT DOCUMENTS

| | | | | |
|---|---|---|---|---|
| 8,891,143 | B2 * | 11/2014 | Omori | B65H 3/0669 358/474 |
| 10,214,374 | B2 * | 2/2019 | Machida | B65H 1/04 |
| 10,543,997 | B2 * | 1/2020 | Sawashima | B65H 3/0669 |
| 2011/0156339 | A1 * | 6/2011 | Nakano | B65H 1/266 271/4.11 |
| 2014/0151954 | A1 * | 6/2014 | Furusawa | B65H 3/5215 271/160 |
| 2014/0339761 | A1 * | 11/2014 | Oikawa | B65H 1/08 271/153 |
| 2017/0126912 | A1 | 5/2017 | Shuto | |

FOREIGN PATENT DOCUMENTS

| | | | |
|---|---|---|---|
| JP | 08290835 | A | * 11/1996 |
| JP | 2002347986 | A | * 12/2002 |
| JP | 2003-072985 | A | 3/2003 |
| JP | 2016-050066 | A | 4/2016 |
| JP | 2016124626 | A | * 7/2016 |
| JP | 2017-088259 | A | 5/2017 |

* cited by examiner

*Primary Examiner* — Howard J Sanders

(74) *Attorney, Agent, or Firm* — Venable LLP

(57) ABSTRACT

The sheet feeding apparatus includes a stacking device on which a sheet is stacked, a feeding device, which is configured to feed the stacked sheet, a contact portion arranged at a position at which the stacked sheet is brought into contact with the contact portion, and a moving member, which is movable in a direction in which a protruding amount of the stacked sheet changes.

14 Claims, 7 Drawing Sheets

SHEET FEEDING APPARATUS AND IMAGE FORMING APPARATUS

BACKGROUND OF THE INVENTION

Field of the Invention

The present invention relates to a sheet feeding apparatus, which is configured to feed a sheet, and to an image forming apparatus including the sheet feeding apparatus.

Description of the Related Art

An electrophotographic image forming apparatus generally includes a sheet feeding apparatus, which is configured to feed a sheet to an image forming unit.

In a sheet feeding apparatus described in Japanese Patent Application Laid-Open No. 2003-72985, a detection flag for detecting presence or absence of a sheet is arranged above a tray for receiving sheets to be stacked thereon, and is held in contact with an upper surface of sheets stacked on the tray.

In the sheet feeding apparatus described in Japanese Patent Application Laid-Open No. 2003-72985, the detection flag is held in contact with the upper surface of the sheet during sheet feeding. Therefore, there is a fear in that the detection flag causes a resistance against conveyance of the sheet, which may lead to a conveyance failure of the sheet such as skew feed of the sheet.

SUMMARY OF THE INVENTION

An aspect of the present invention is a sheet feeding apparatus capable of stably feeding a sheet, and an image forming apparatus including the sheet feeding apparatus.

Another aspect of the present invention is a sheet feeding apparatus including a stacking device having a stacking surface on which a sheet is to be stacked, a feeding device configured to feed the sheet stacked on the stacking surface, a contact portion including a first surface arranged at a position at which a downstream side edge of the sheet in a sheet feeding direction of a sheet stacked on the stacking device is brought into contact with the first surface, and a moving member having a contact surface with which the downstream side edge of the sheet in the sheet feeding direction of the sheet to be fed by the feeding device is brought into contact, wherein the contact surface is movable so that a protruding amount of the contact surface from the first surface changes.

A further aspect of the present invention is an image forming apparatus including a sheet feeding apparatus including a stacking device having a stacking surface on which a sheet is to be stacked, a feeding device configured to feed the sheet stacked on the stacking surface, a contact portion including a first surface, the contact portion arranged at a position at which a downstream side edge of the sheet stacked on the stacking surface in a sheet feeding direction is brought into contact with the contact portion, and a moving member having a contact surface for allowing the downstream side edge of the sheet, which is stacked on the stacking surface to be fed by the feeding device, in the sheet feeding direction to be brought into contact therewith, the moving member being movable in a direction in which a protruding amount of the contact surface from the first surface changes, a sensor unit configured to output a signal according to a position of the moving member, and an image forming unit configured to form an image on the sheet fed by the sheet feeding apparatus.

A still further aspect of the present invention is a sheet feeding apparatus including a stacking device having a stacking surface on which a sheet is to be stacked, a separation tilt surface arranged so that an angle formed between the separation tilt surface and the stacking surface of the stacking device is set to an obtuse angle, and a feeding device swingably supported above the stacking surface, the feeding device brought into contact with the sheet stacked on the stacking surface to feed the sheet toward the separation tilt surface, and a moving member having a contact surface for allowing the sheet stacked on the stacking surface to be brought into contact therewith, the contact surface protrudable from the separation tilt surface so as to traverse a position at which a plane including the stacking surface and a plane including the separation tilt surface intersect with each other.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Embodiments of the present invention are now described in detail with reference to the drawings. In the following description, the term "sheet" encompasses plain paper as well as special paper such as coated paper, a recording material having a special shape such as an envelope or an index sheet, a plastic film for an overhead projector, and cloth.

First Embodiment

Figure 1:
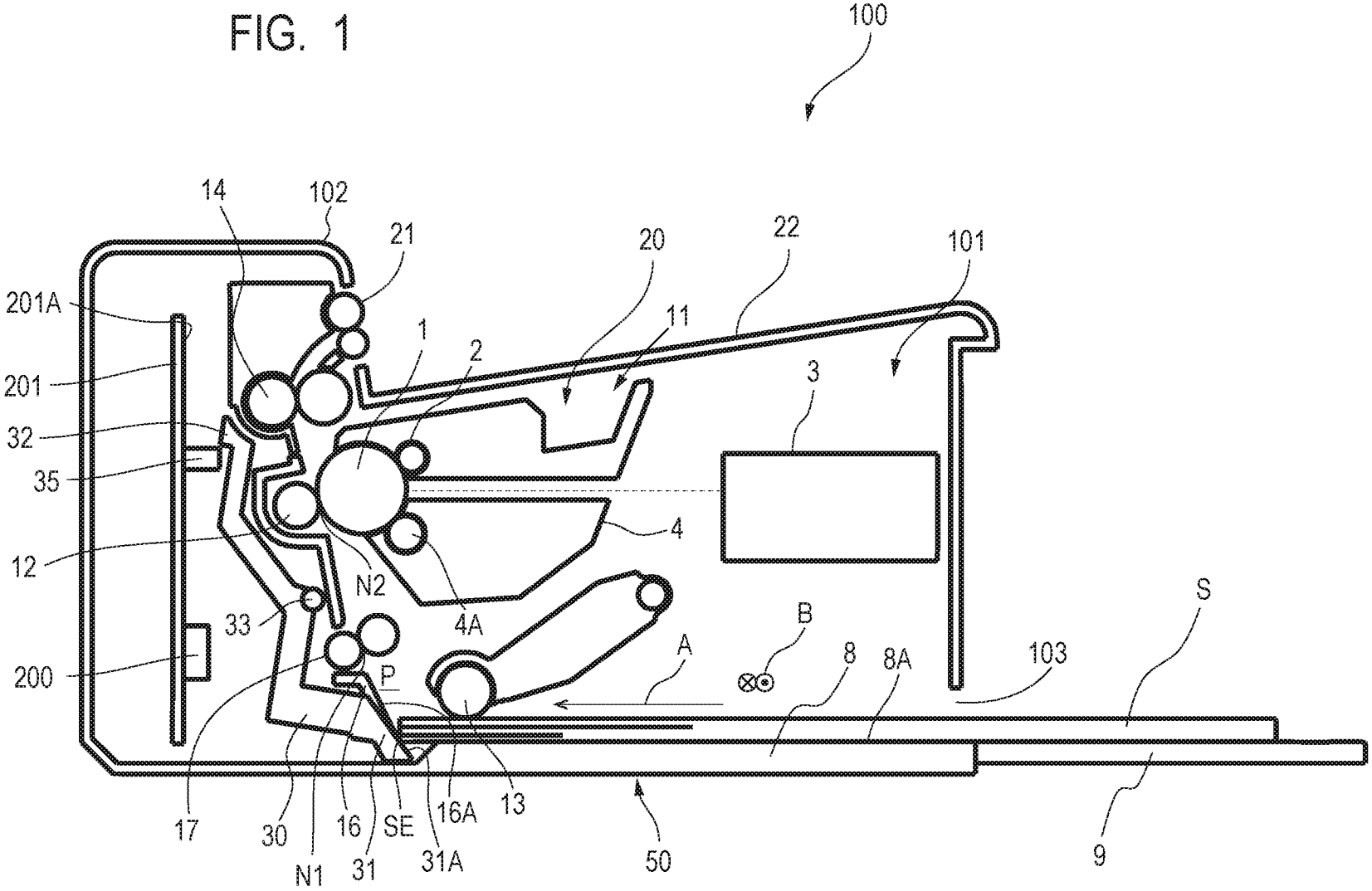
FIG. 1 is a schematic view for illustrating a configuration of a printer as an example of an image forming apparatus according to a first embodiment of the present invention.

FIG. 1 is a schematic view for illustrating a configuration of a printer 100 as an example of an image forming apparatus according to a first embodiment of the present invention. The printer 100 includes a sheet feeding apparatus 50 configured to feed a sheet S. The sheet feeding apparatus 50 includes a control unit 200 configured to control components of the printer 100, including components of the sheet feeding apparatus 50. Under control of the control unit 200, the printer 100 forms an image on the sheet S fed by the sheet feeding apparatus 50 based on image information input from an external device such as a computer. In the first embodiment, the control unit 200 is provided to a control board which is configured to control the printer 100. However, the sheet feeding apparatus 50 may be provided as a unit so that the control unit 200 is provided to the unit of the sheet feeding apparatus and is connected to a control unit of the printer 100 through an electric signal. In FIG. 1, there is illustrated a cross section of the printer 100 as viewed in a width direction B which is orthogonal to a sheet feeding direction A for the sheet S fed by the sheet feeding apparatus 50. In FIG. 1, the right side corresponds to a front side (operation side) of the printer 100. An insertion port 103 for insertion of a bundle of the sheets S into the printer 100, which is described later, is formed on the front side of the printer 100.

The printer 100 according to the first embodiment is an electrophotographic monochrome laser beam printer. An apparatus main body 101 of the printer 100, which also serves as an apparatus main body of the sheet feeding apparatus 50, is arranged inside an exterior case 102. A process cartridge 11 is removably mounted to the apparatus main body 101. The control unit 200 is formed of, for example, a semiconductor package, and is mounted to a mounting surface 201A of a printed board 201 which is arranged inside the exterior case 102. The control unit 200 includes a central processing unit (CPU), a memory, and other components. Further, on the front side of the printer 100, there is provided an operation panel (operation portion; not shown) which is configured to allow input of various information by a user and to display information from the printer 100. The operation panel is connected to the control unit 200. Further, a personal computer (PC; not shown) which is configured to allow input of the image information and other information to the printer 100 is connected to the control unit 200 of the printer 100.

In the first embodiment, one process cartridge 11 is mounted to the apparatus main body 101. However, the number of the process cartridge 11 is not limited to one, and is suitably set as needed. For example, in a case in which a full-color image is to be formed, the number of the process cartridges 11 which are mounted to the apparatus main body 101 is four. Further, description is made of a case in which the image forming apparatus is the printer, but the image forming apparatus is not limited to the printer. The present invention is also applicable to an image forming apparatus such as a copying machine, a facsimile, or a multifunction peripheral having a combination of functions of the copying machine and the facsimile.

The printer 100 includes a registration roller pair 17, an image forming unit 20, and a discharge roller pair 21 being an example of a discharge unit. The image forming unit 20 includes a transfer roller 12 being an example of a transfer unit, an exposure apparatus 3 being an example of an exposure unit, the process cartridge 11 described above, and a fixing device 14 being an example of a fixing unit. The process cartridge 11 includes a photosensitive drum 1 being an example of an image bearing member configured to bear a toner image thereon, a charge roller 2 being an example of a charge unit arranged on the periphery of the photosensitive drum 1, and a developing device 4 being an example of a developing unit.

The photosensitive drum 1 includes a cylindrical member and a photosensitive layer arranged on a surface of the cylindrical member, and can be rotated by drive of a motor (not shown). The charge roller 2 charges a surface of the photosensitive drum 1 to a uniform potential with an applied charging voltage. The exposure device 3 scans a laser beam to form an electrostatic latent image of an image on the surface of the photosensitive drum 1. The developing device 4 includes a developing roller 4A and causes the developing roller 4A to carry a toner and supply the toner to the photosensitive drum 1 so as to develop the electrostatic latent image on the photosensitive drum 1 as a toner image.

Simultaneously with an image formation process performed by the image forming unit 20, the sheet S is fed from the sheet feeding apparatus 50 and conveyed to a nip N1 in the registration roller pair 17. A downstream side edge SE of the sheet S fed by the sheet feeding apparatus 50 in the sheet feeding direction A is brought into contact with the registration roller pair 17 under a rotation stopped state to form a loop in the sheet S, thereby correcting skew feed of the sheet S. Then, the registration roller pair 17 is driven to rotate to convey the sheet S to a transfer nip N2 which is formed between the photosensitive drum 1 and the transfer roller 12 in accordance with transfer timing at the transfer nip N2.

The toner image borne on the photosensitive drum 1 is transferred onto the sheet S at the transfer nip N2 by application of a bias voltage to the transfer roller 12. An adhering substance such as a transfer residual toner remaining on the photosensitive drum 1 without being transferred onto the sheet S is removed by a cleaner (not shown). The sheet S having the unfixed image formed thereon is heated by the fixing device 14 while being pressurized. In this manner, the toner image transferred onto the sheet S melts and adheres to the sheet S. The sheet S having the image fixed thereon by the fixing device 14 is discharged to a discharge tray 22 provided at a top of the exterior case 102 by the discharge roller pair 21, thereby completing a printing operation.

The sheet feeding apparatus 50 includes a feeding tray (tray) 8 being an example of a stacking device. The feeding tray 8 has a stacking surface 8A on which the sheet S is stacked. Further, the sheet feeding apparatus 50 includes a feeding roller 13 being an example of a feeding device. The feeding roller 13 is configured to feed the sheet S stacked on the stacking surface 8A of the feeding tray 8. In the first embodiment, it is assumed that the sheet S is supplied to the sheet feeding apparatus 50 directly by manual feeding.

The feeding tray 8 is fixed with respect to the apparatus main body 101. More specifically, the feeding tray 8 is formed integrally with a bottom portion of the exterior case 102. The feeding tray 8 may be formed independently of the exterior case 102. In this case, the feeding tray 8 is fixed to the bottom portion of the exterior case 102. The insertion port 103 through which the sheet S is inserted is formed in a lower portion of a side wall portion of the exterior case 102. An auxiliary tray 9 which is freely slidable is provided to the feeding tray 8.

When a user inserts the sheet S through the insertion port 103, the sheet S is stacked on the stacking surface 8A of the feeding tray 8. The feeding roller 13 is swingably supported above the stacking surface 8A, and is brought into contact with the sheet S stacked on the stacking surface 8A to feed the sheet S. In the first embodiment, a plurality of sheets S can be stacked on the stacking surface 8A of the feeding tray 8. When the plurality of sheets S are stacked on the stacking surface 8A of the feeding tray 8, an uppermost one of the sheets S is fed by the feeding roller 13 toward the image forming unit 20.

On a downstream side in the sheet feeding direction A for the sheet S with respect to the feeding tray 8, there is arranged a wall portion 16 (contact portion) having a wall surface 16A with which the downstream edge SE of the sheet S inserted by the user through the insertion port 103 is brought into contact.

The registration roller pair 17 is arranged above the feeding tray 8. The wall surface 16A of the wall portion 16 extends upward toward the nip N1 in the registration roller pair 17, thereby forming a conveyance path P for conveying the sheet S to the registration roller pair 17. The wall surface 16A is a surface inclined with respect to the stacking surface 8A of the feeding tray 8 and serves as a separation tilt surface for separating the plurality of sheets S stacked on the stacking surface 8A of the feeding tray 8 one by one in cooperation with the feeding roller 13. An angle between the stacking surface 8A and the wall surface 16A on the conveyance path P side is set to an obtuse angle. As a specific value of the obtuse angle, an angle within a range of from 100° to 130° enables suitable separation for various types of sheets. In the first embodiment, the obtuse angle is set to about 115°. The sheet fed by the feeding roller 13 is conveyed with a change in direction of movement of the sheet S at the wall surface 16A from the sheet feeding direction A to a sheet conveying direction (direction along the wall surface 16A). At this time, when a sheet located below the uppermost sheet is fed by being dragged by the uppermost sheet, the change in direction of movement of the uppermost sheet at the wall surface 16A causes the sheet located below the uppermost sheet to be pressed and then stopped under a state in which a leading edge thereof is held in contact with the wall surface 16A. Thus, only the uppermost sheet is conveyed separately. In this manner, even when the plurality of sheets S are fed by the feeding roller 13, only the uppermost sheet S with which the feeding roller 13 is held in contact is fed and selectively conveyed in a direction toward the downstream side.

The photosensitive drum 1 and the transfer roller 12 are arranged above the registration roller pair 17. The fixing device 14 is arranged above the photosensitive drum 1 and the transfer roller 12. Specifically, the transfer roller 12 and the fixing device 14 are arranged under the stated order along the conveyance path P for the sheet extending upward from the sheet feeding apparatus 50. Based on the above-mentioned arrangement relationship, the sheet S stacked on the feeding tray 8 is subjected to image formation in the image forming unit 20 while being conveyed upward, and is then discharged to the discharge tray 22 provided to the upside portion of the printer 100. The printed board 201 on which the control unit 200 is mounted is arranged on a side (rear side of the printer 100) opposite to the feeding tray 8 (conveyance path P) with respect to the wall portion 16. The printed board 201 is arranged so that the mounting surface 201A is to be substantially vertical. In this manner, the printer 100 is downsized.

Further, the sheet feeding apparatus 50 includes a detection flag 30 being an example of a moving member and a photosensor 35 being an example of a sensor unit. The detection flag 30 is formed into an arm-like shape extending in a longitudinal direction. The detection flag 30 is supported so as to be swingable with respect to the apparatus main body 101. More specifically, the detection flag 30 is supported on the apparatus main body 101 at a supporting unit 33 so as to be swingable about the supporting unit 33 provided between one end portion 31 and another end portion 32 of the detection flag 30 in the longitudinal direction.

The supporting unit 33 is located on a side opposite to the conveyance path P with respect to the wall portion 16. Specifically, the detection flag 30 is arranged between the printed board 201 and the wall portion 16 so as to be swingable. The swinging of the detection flag 30 about the supporting unit 33 moves the one end portion 31 forward and backward with respect to the conveyance path P, and brings the another end portion 32 into contact with and away from the photosensor 35.

In the first embodiment, the photosensor 35 is a photo-interrupter, and is mounted to the mounting surface 201A of the printed board 201 so as to enable output of an electric signal to the control unit 200. The photosensor 35 includes a light-emitting element and a light-receiving element (not shown), and outputs an electric signal in accordance with whether or not the another end portion 32 of the detection flag 30 is present between the light-emitting element and the light-receiving element, specifically, whether or not the light-receiving element has received light.

Figure 2A:
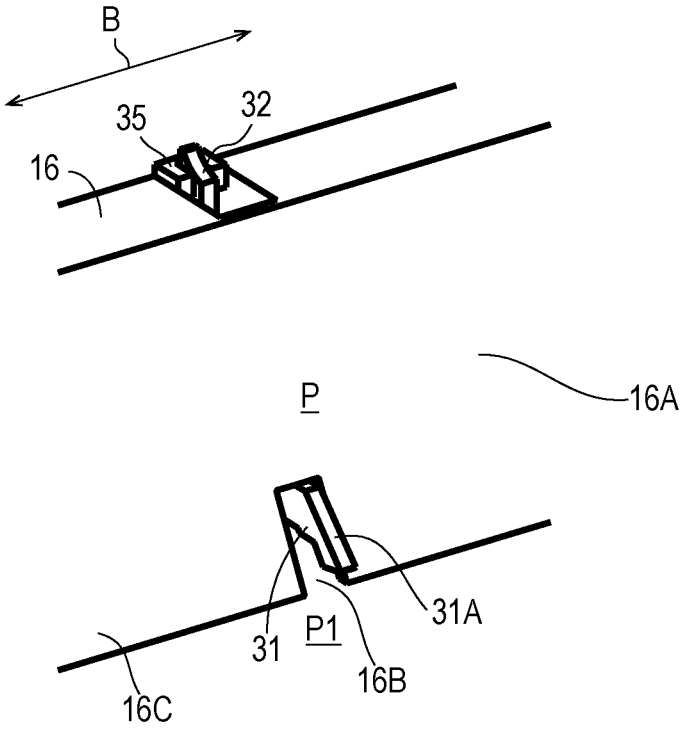
FIG. 2A is a perspective view of a main part of the printer according to the first embodiment of the present invention.
Figure 2B:
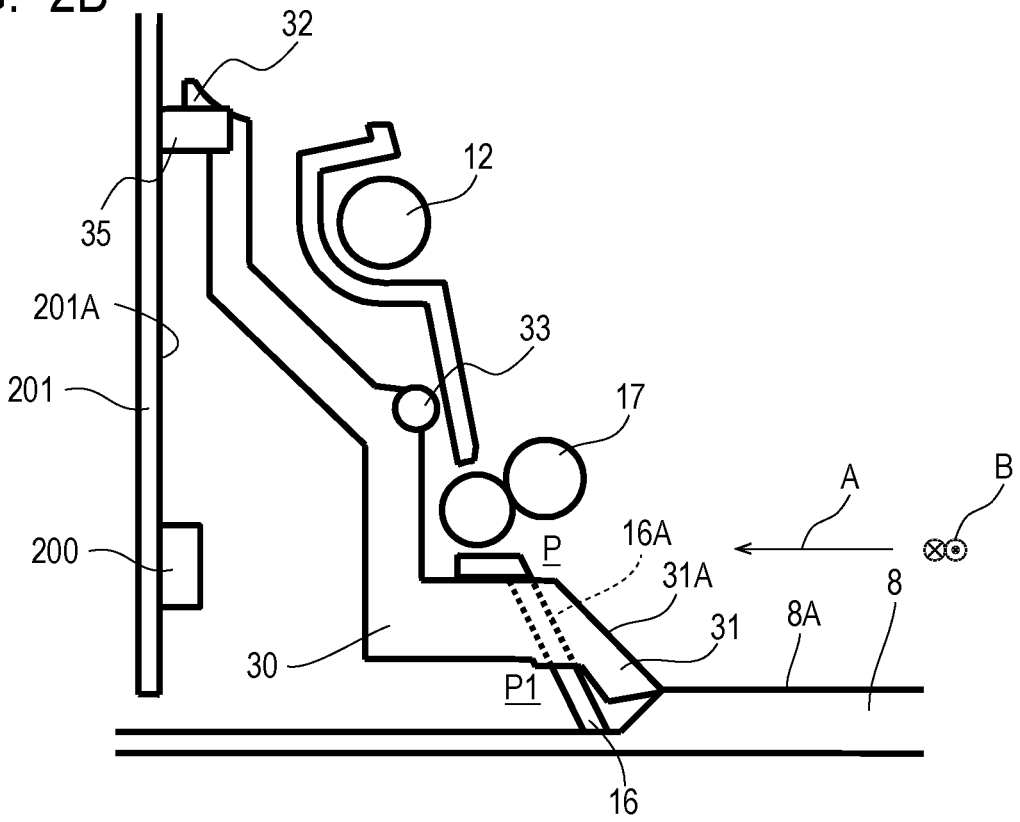
FIG. 2B is a sectional view of a main part of the printer according to the first embodiment of the present invention.

The detection flag 30 being the moving member is now described in detail. FIG. 2A is a perspective view of a main part of the printer 100, and is an illustration of a state in which the sheet S is not stacked on the feeding tray 8, in the first embodiment. FIG. 2B is a sectional view of a main part of the printer 100, and is an illustration of a state in which the sheet S is not stacked on the feeding tray 8, in the first embodiment.

A case in which the sheet S is not stacked on the feeding tray 8 is now described with reference to FIG. 2A and FIG. 2B. The sheet S may be stacked in any of right edge alignment, left edge alignment, and center alignment with respect to the feeding tray 8. In the first embodiment, it is assumed that the sheet S is stacked in center alignment. The term "center alignment" refers to a state in which, in a printer which involves conveyance of the sheet based on a center of the conveyance path P in the width direction B as a conveyance reference, the sheet S is placed on the feeding tray 8 so that a center of the sheet S is aligned with the conveyance reference. The terms "right alignment" and "left alignment" refer to a state in which, in a printer which involves conveyance of the sheet based on a right end or a left end of the conveyance path P as a conveyance reference of the sheet, the sheet S is placed on the feeding tray 8 so that a right edge or a left edge of the sheet S is aligned with the conveyance reference. The detection flag 30 and the photosensor 35 are arranged at positions at which the presence or absence of the sheet S can be detected using the detection flag 30 and the photosensor 35 even when any size of the sheet S is stacked on the feeding tray 8. For example, the detection flag 30 and the photosensor 35 are arranged at the center in the width direction B with respect to the feeding tray 8 and the wall portion 16.

An opening port 16B which is positioned at the center in the width direction B is formed in a lower end portion 16C of the wall portion 16. The detection flag 30 has a contact surface 31A. The contact surface 31A is an end surface of the one end portion 31, and allows the downstream side edge SE (FIG. 1) of the sheet S, which is stacked on the stacking surface 8A of the feeding tray 8, in the sheet feeding direction A to be brought into contact therewith.

When the sheet S is not stacked on the stacking surface 8A of the feeding tray 8, the detection flag 30 is supported so as to be positioned at a first position P1 at which the contact surface 31A entirely protrudes through the opening port 16B toward the conveyance path P beyond the wall surface 16A. The opening port 16B is formed at a position at which a plane including the stacking surface 8A and a plane including the wall surface 16A intersect with each other (position corresponding to a position 31P illustrated in FIG. 4, which is described later). The contact surface 31A of the detection flag 30 is formed so as to be protrudable from the wall surface 16A toward the stacking surface 8A side through the opening port 16B so as to traverse the position of intersection between the two planes. Further, when the detection flag 30 is located at the first position P1, the sheet S inserted to be placed on the stacking surface 8A is prevented from entering a space under the detection flag 30 by positioning a lower end of the contact surface 31A of the detection flag 30 at the same height as that of the stacking surface 8A of the feeding tray 8 or below the stacking surface 8A. For the purpose described above, a recessed portion in which the lower end of the detection flag 30 is to be positioned is formed between the wall surface 16A and the feeding tray 8.

In the first embodiment, the detection flag 30 is urged toward the first position P1 by its own weight (gravity) without using an urging member such as a spring, and is held at the first position P1 at which equilibrium with respect to the own weight is achieved when the sheet S is not stacked on the stacking surface 8A of the feeding tray 8. Specifically, the detection flag 30 is set so as to be brought into a state illustrated in FIG. 2B (state of being positioned at the first position P1) when the supporting unit 33, which supports the detection flag 30 swingably, and a center of gravity of the detection flag 30 match each other in a vertical line.

A portion of the detection flag 30 other than the contact surface 31A may allow contact with a restricting portion (not shown) or an edge of the opening port 16B to restrict the detection flag 30 so as to prevent movement of the detection flag 30 toward the conveyance path P beyond the first position P1. In this manner, the lower end side of the detection flag 30 is formed so as to protrude from the wall surface 16A by a predetermined amount.

When the detection flag 30 is moved to the first position P1, the another end portion 32 of the detection flag 30 is moved to a position between the light-emitting element and the light-receiving element (not shown) of the photosensor 35 to block entry of light (block light) from the light-emitting element to the light-receiving element. The photosensor 35 outputs, to the control unit 200, an electric signal indicating that the light has been blocked. For example, the photosensor 35 outputs an off-signal at a voltage lower than a predetermined voltage to the control unit 200 when the light is blocked. When the input of the electric signal is received, the control unit 200 detects the absence of the sheet S on the feeding tray 8. When the off-signal is input while the sheets are being continuously fed by the feeding roller 13 being the feeding device, the control unit 200 stops the feeding operation. Further, under a state in which the off-signal is input to the control unit 200, the control unit 200 does not allow the feeding roller 13 to start the sheet feeding operation even when a sheet feeding signal for feeding the sheet is input from the PC or other devices connected to the printer 100. At the same time, the control unit 200 outputs a signal for causing an operation panel of the printer 100 or the PC connected to the printer 100 to display information indicating the absence of the sheet S on the feeding tray 8, to thereby cause the operation panel or the PC to display information indicating the absence of the sheet, and notify the user of the absence of the sheet.

Figure 3A:
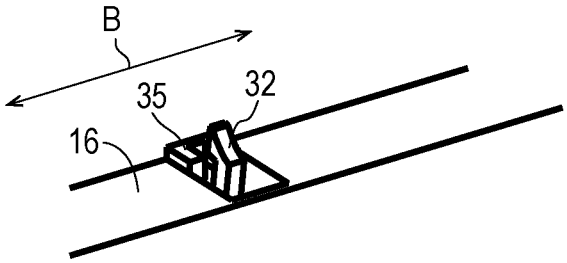
FIG. 3A is a perspective view of the main part of the printer according to the first embodiment of the present invention.
Figure 3A:
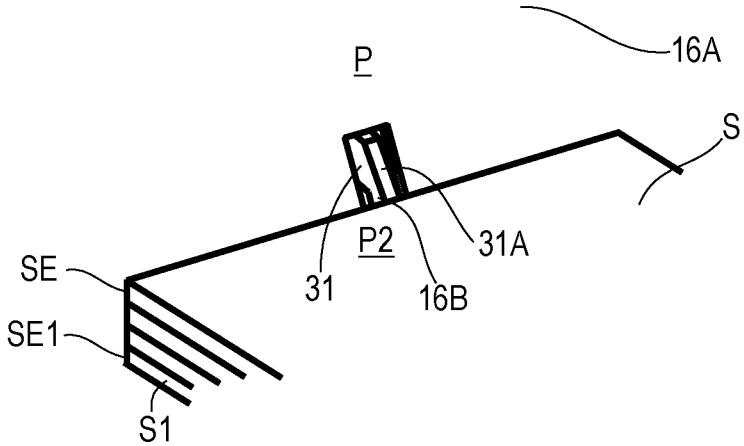
Figure 3B:
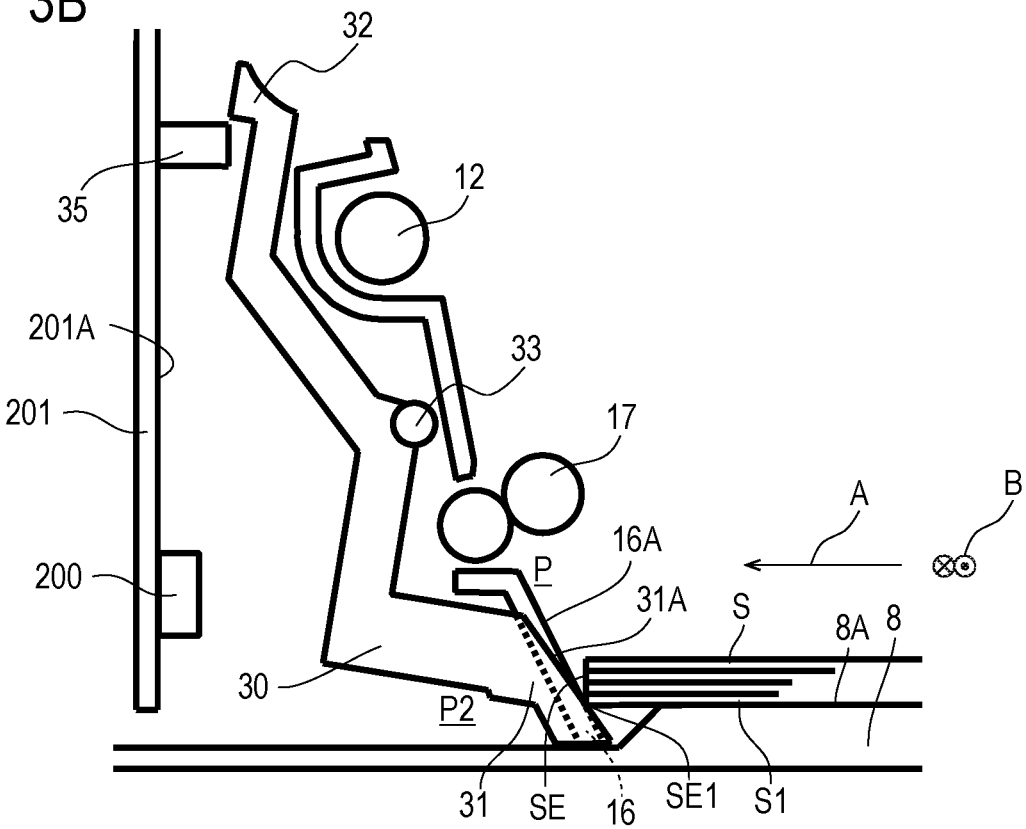
FIG. 3B is a sectional view of the main part of the printer according to the first embodiment of the present invention.

Next, a case in which the plurality of sheets S are stacked on the feeding tray 8 is described. FIG. 3A is a perspective view of the main part of the printer 100, and is an illustration of a state in which the plurality of sheets S are stacked on the feeding tray 8, in the first embodiment. FIG. 3B is a sectional view of the main part of the printer 100, and an illustration of a state in which the plurality of sheets S are stacked on the feeding tray 8, in the first embodiment.

When the plurality of sheets S are stacked on the stacking surface 8A of the feeding tray 8 so that the downstream side edge SE of each of the sheets S is brought into contact with the wall surface 16A as illustrated in FIG. 3A, the sheets S are positioned in the sheet feeding direction A with respect to the feeding tray 8. At this time, a downstream side edge SE1 of a lowermost sheet S1 of the plurality of sheets S in the sheet feeding direction A is brought into contact with the contact surface 31A. The detection flag 30 is pushed by the sheet S1 which is brought into contact with the contact surface 31A to swing about the supporting unit 33 as a center to be moved from the first position P1 illustrated in FIG. 2A and FIG. 2B to a second position P2 illustrated in FIG. 3A and FIG. 3B.

Figure 4:
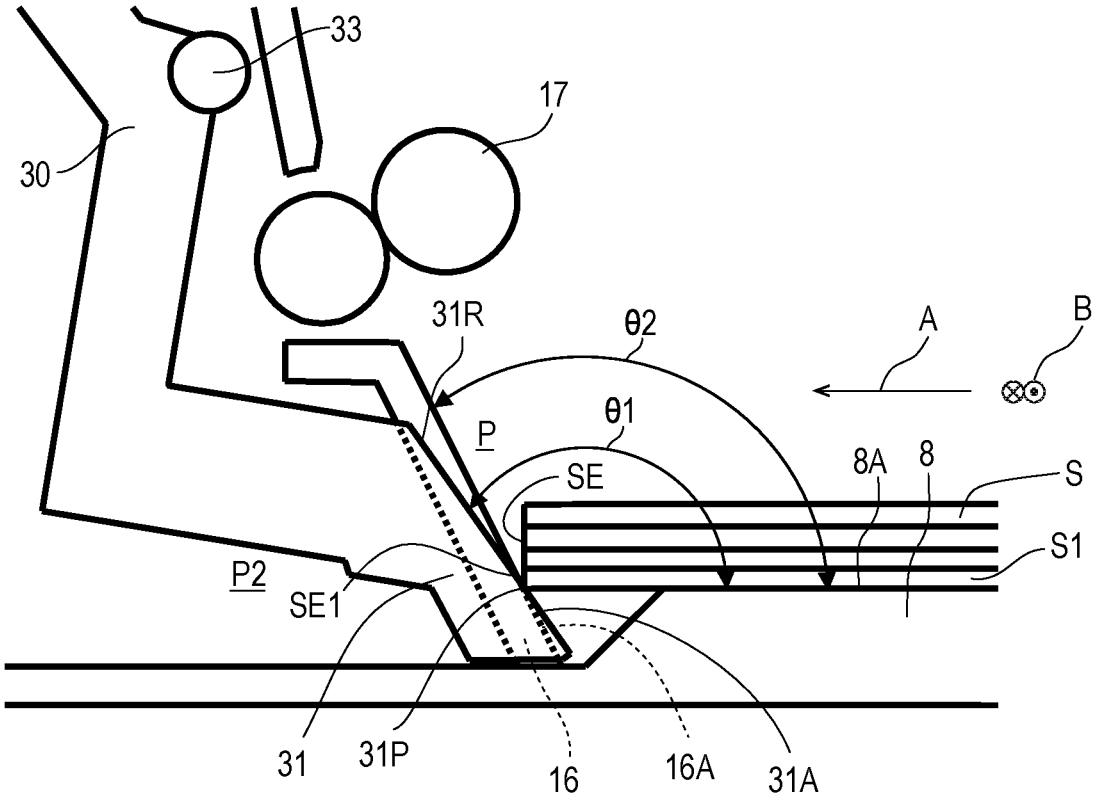
FIG. 4 is an enlarged view of FIG. 3B.

FIG. 4 is an enlarged view of FIG. 3B. As illustrated in FIG. 4, the detection flag 30 is pushed by the lowermost sheet S1 to be moved to the second position P2. The second position P2 is a position to which a region 31R of the contact surface 31A, which is located on a downstream side in the sheet conveying direction with respect to the position 31P at which the downstream side edge SE1 of the lowermost sheet S1 of the plurality of sheets S stacked on the stacking surface 8A is held in contact with the contact surface 31A, is retreated from the conveyance path P. Specifically, when the detection flag 30 is moved to the second position P2, the region 31R of the contact surface 31A does not protrude into the conveyance path P. Specifically, the detection flag 30 is positioned inside the opening port 16B. When the detection flag 30 is moved to the second position P2, the region 31R is retreated from the conveyance path P. Therefore, the sheets positioned above the lowermost sheet S1 of the plurality of sheets S are not brought into contact with the contact surface 31A. As described above, a position of the supporting unit 33 and a shape of the contact surface 31A are set so that the detection flag 30 is moved between the first position P1 and the second position P2 to change a protruding amount of the one end portion 31 of the detection flag 30 from the wall surface 16A.

Trailing edges of the sheets S in a bundle are not necessarily aligned vertically. In some cases, the bundle of the sheets S is inserted to be stacked on the feeding tray 8 with the sheet positioned above the lowermost sheet S1 protruding to an upstream side, and the protruding sheet S pushes the contact surface 31A of the detection flag 30. Even in this case, the sheet S which is first brought into contact with the detection flag 30 pushes the detection flag 30 to turn the photosensor 35 from a light-blocking state into a light-entering state. Thus, the detection flag 30 is not necessarily moved to the position illustrated in FIG. 4. As described above, the second position P2 includes not only the position of the detection flag 30 under the state in which the lowermost sheet S1 is held in contact with the detection flag 30 but also the position of the detection flag 30 when the sheet positioned above the lowermost sheet S1 pushes the contact surface 31A to cause the photosensor 35 to output the off-signal. Specifically, the position of the detection flag 30 given when any one of the plurality of sheets stacked on the stacking surface 8A is brought into contact with both the contact surface 31A of the detection flag 30 and the wall surface 16A is defined as the second position P2.

When the photosensitive sensor 35 is placed in the light-entering state by the detection flag 30, the presence of the sheet is detected to enable the feeding of the sheet. Thus, the position of the detection flag 30 given when the photosensor 35 is turned from the light-blocked state into the light-entering state may be defined as the second position P2. Specifically, even under a state in which the sheets are not held in contact with both the contact surface 31A and the wall surface 16A, the position of the detection flag 30 given when the sheets are stacked on the stacking surface 8A to be fed by the feeding roller 13 to turn the photosensor 35 into the light-entering state may be defined as the second position P2.

When the downstream side edge SE1 of the lowermost sheet S1 of the plurality of sheets S is brought into contact with the wall surface 16A, the detection flag 30 is moved from the first position P1 to the second position P2 by a pushing force of the sheet S1 against urging with the gravity. Then, the detection flag 30 maintains the state of being located at the second position P2 until no sheet S is left on the stacking surface 8A of the feeding tray 8. When no sheet S is left on the stacking surface 8A, the detection flag 30 is moved to the first position P1 by its own weight.

When the detection flag 30 is moved to the second position P2, the other end portion 32 of the detection flag 30 is moved to a position of being retreated from the position between the light-emitting element and the light-receiving element (not shown) of the photosensor 35. Thus, the light from the light-emitting element is received by (enters) the light-receiving element without being blocked by the other end portion 32. The photosensor 35 outputs, to the control unit 200, the electric signal indicating that the light has been received by the light-receiving element. For example, the photosensor 35 outputs an on-signal at a voltage higher than a predetermined voltage to the control unit 200. When the input of the electric signal is received, the control unit 200 detects the presence of the sheet S on the feeding tray 8. When the sheet feeding signal for feeding the sheet is input to the control unit 200 under the on-signal input state, the control unit 200 causes the feeding roller 13 to perform the sheet feeding operation. At the same time, the control unit 200, which has received the input of the on-signal, outputs a signal for display of information indicating the presence of the sheets on the feeding tray 8 to the operation panel of the printer 100 or the PC connected to the printer 100.

As described above, the detection flag 30 is movable between the first position P1 and the second position P2. The control unit 200 receives the input of the signal from the photosensor 35, for example, the on-signal or the off-signal described above to detect the presence or absence of the sheet S on the feeding tray 8. Further, when the input of the on-signal or the off-signal described above is received, the control unit 200 controls the sheet feeding operation or outputs the signal for causing the operation panel of the printer 100 or the PC connected to the printer 100 to display information indicating the presence or absence of the sheet on the feeding tray 8. In the first embodiment, the control unit 200 is configured to perform control based on the presence of the sheet detected with the on-signal and the absence of the sheet detected with the off-signal. However, the control unit 200 may perform control based on the absence of the sheet detected with the on-signal and the presence of the sheet detected with the off-signal. Specifically, the position of the photosensor 35 may be set so that the photosensor 35 is turned off when the detection flag 30 is located in the first position P1, and is turned on when the detection flag 30 is located in the second position P2.

In the first embodiment, each of the contact surface 31A of the detection flag 30, the stacking surface 8A of the feeding tray 8, and the wall surface 16A of the wall portion 16 is a flat surface. When the downstream side edge SE1 of the lowermost sheet S1 is brought into contact with the wall surface 16A to be brought into contact with the contact surface 31A of the detection flag 30, the detection flag 30 is moved from the first position P1 to the second position P2 to change an angle of inclination of the contact surface 31A. In this manner, when the detection flag 30 is moved to the second position P2, the region 31R of the contact surface 31A is retreated from the conveyance path P so as not to protrude toward the conveyance path P beyond the wall surface 16A. Specifically, an angle θ1 formed between the contact surface 31A and the stacking surface 8A is equal to or larger than an angle θ2 formed between the wall surface 16A and the stacking surface 8A as viewed in the width direction B under a state in which the sheet S is stacked on the stacking surface 8A, specifically, the detection flag 30 is moved to the second position P2. The angles θ1 and θ2 are angles on the conveyance path P side, specifically, obtuse angles. As described above, the angle formed between the contact surface 31A and the stacking surface 8A is set larger than the angle formed between the wall surface 16A and the stacking surface 8A while the detection flag 30 is present within a movable range between the first position P1 and the second position P2. Therefore, the region 31R of the contact surface 31A is retreated from the conveyance path P.

When the sheet feeding signal is input to the control unit 200 in the above-mentioned configuration, the control unit 200 detects whether or not the sheet is present on the feeding tray 8 based on the electric signal output from the photosensor 35. When the sheet is present on the feeding tray 8, the control unit 200 controls the drive of the feeding roller 13 so as to start the sheet feeding operation. Among the plurality of sheets S stacked on the stacking surface 8A of the feeding tray 8, the uppermost sheet S which is held in contact with the feeding roller 13 is fed by the feeding roller 13. Then, the sheet S being fed by the feeding roller 13 is conveyed upward along the wall surface 16A to be guided to the registration roller pair 17. At this time, the downstream side edge SE1 of the lowermost sheet S1 is held in contact with the contact surface 31A at the position 31P, and the region 31R located downstream of the position 31P in the sheet conveying direction is retreated from the conveyance path P. Therefore, the sheet S to be fed can be prevented from being brought into contact with the detection flag 30 so as to prevent the detection flag 30 from causing a resistance during the feeding of the sheet S. In this manner, occurrence of skew feed or a separation failure of the sheet S can be suppressed, and hence the sheet S can be stably fed to the image forming unit 20. When no sheet S is left on the feeding tray 8 during the sheet feeding operation for continuously feeding the sheets, the control unit 200 stops the sheet feeding operation and the image forming operation in the image forming unit based on the detection signal output from the photosensor 35. Then, the control unit 200 notifies the user of the absence of the sheet S on the feeding tray 8.

Further, in the first embodiment, the detection flag 30 is urged toward the first position P1 by its own weight, and hence an urging member can be omitted. Therefore, the number of components can be reduced to achieve cost reduction. Further, the reduction of the number of components simplifies the configuration, and hence the sheet feeding apparatus 50, specifically, the printer 100 can be downsized.

Further, in the first embodiment, as illustrated in FIG. 1, the photosensor 35 is arranged above the transfer nip N2. Further, the supporting unit 33 serving as a center of pivot is arranged above the nip N1 in the registration roller pair 17 and below the transfer nip N2. The photosensor 35 is arranged above the transfer nip N2. Therefore, a length of the detection flag 30 in the longitudinal direction between the supporting unit 33 as the center of pivot and the other end portion 32 can be set large. Therefore, the amount of movement of the other end portion 32 given when the detection flag 30 is moved between the first position P1 and the second position P2 can be increased. In this manner, detection sensitivity for the presence or absence of the sheet S using the photosensor 35 and the detection flag 30 is improved.

Further, in the first embodiment, the supporting unit 33 for the detection flag 30 is arranged on the side opposite to the feeding tray 8 (conveyance path P) side with respect to the wall portion 16. Therefore, most part of the detection flag 30 except for a part of the one end portion 31 is arranged on the side opposite to the feeding tray 8 (conveyance path P) side with respect to the wall portion 16, specifically, in a clearance between the printed board 201 and the wall portion 16. When the photosensor and the detection flag are arranged below the feeding tray, a large space for arranging the photosensor and the detection flag therein is required to be formed below the feeding tray. As a result, the image forming apparatus is increased in size in the vertical direction. Meanwhile, in the first embodiment, the large space for arranging the photosensor and the detection flag is not required to be formed below the feeding tray 8. Thus, the sheet feeding apparatus 50, specifically, the printer 100 can be downsized.

Second Embodiment

Figure 5:
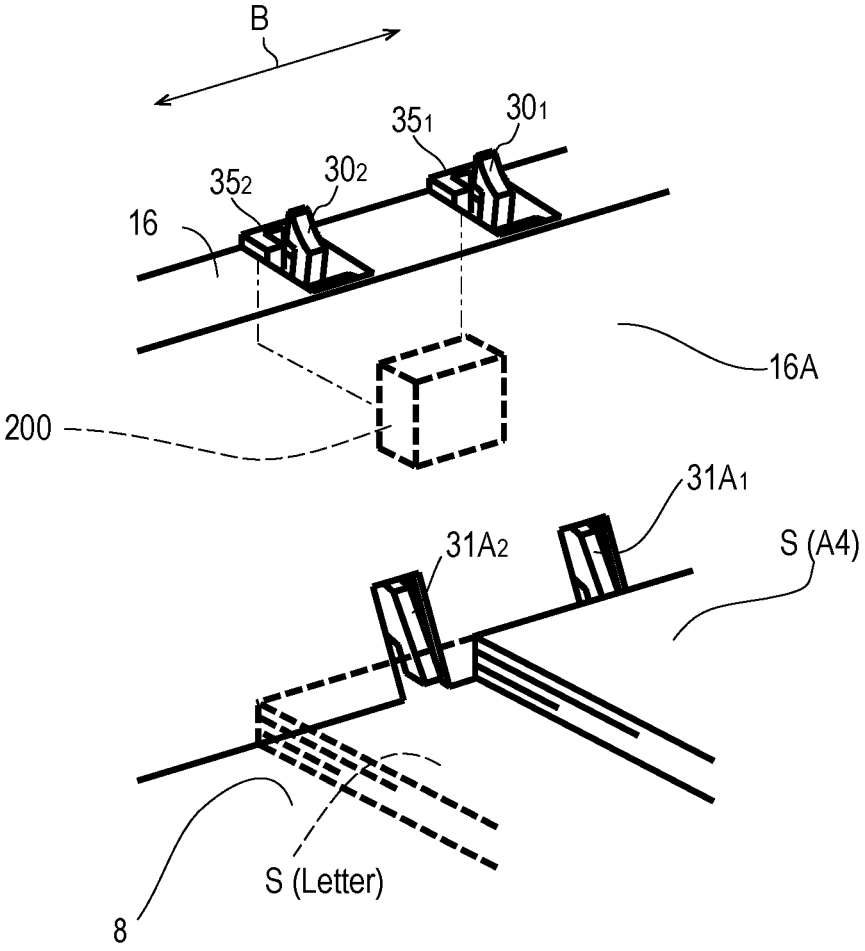
FIG. 5 is a perspective view of a main part of a printer as an example of an image forming apparatus according to a second embodiment of the present invention.

An image forming apparatus including a sheet feeding apparatus according to a second embodiment of the present invention is now described. FIG. 5 is a perspective view of a main part of a printer as an example of an image forming apparatus according to the second embodiment when sheets of various sizes are stacked on the feeding tray. In FIG. 5, the components which are the same as those of the printer according to the first embodiment described above are denoted by the same reference symbols, and the description thereof is omitted. In the first embodiment described above, description is made of the case in which the control unit 200 detects the presence or absence of the sheet S. In the second embodiment, description is made of a case in which the control unit 200 detects a size of the sheet S, specifically, a size of the sheet S in the width direction B. Further, the sheets S have various sizes. In the second embodiment, for convenience of the description, description is made of a case in which the printer deals with two sizes of the sheets S, that is, the sheet S of the A4 size and the sheet S of a letter size. Further, the sheets S may be placed in any of the right edge alignment, the left edge alignment, and the center alignment. In this case, the sheets S are described as being placed in the center alignment in the printer.

The sheet feeding apparatus according to the second embodiment includes a plurality of sets of the detection flag 30 and the photosensor 35 each having the same configuration as that in the first embodiment described above, which are arranged at a distance from each other in the width direction B. In the second embodiment, description is made of a case in which two sets of the detection flag 30 and the photosensor 35 are arranged in the width direction B. The detection flag 30 and the photosensor 35 of one of the two sets are denoted as a detection flag 301 and a photosensor 351, whereas those of another set are denoted as a detection flag 302 and a photosensor 352.

The detection flag 301 and the photosensor 351 are arranged at the center in the width direction B with respect to the feeding tray 8 and the wall portion 16, as in the first embodiment described above. In this manner, the sheet S of any of the sizes is brought into contact with a contact surface 31A1 of the detection flag 301. When a signal input from the photosensor 351 is received, the control unit 200 can detect the presence or absence of the sheet S on the feeding tray 8. Specifically, the control unit 200 detects the presence or absence of the sheet S regardless of whether the size of the sheet S stacked on the feeding tray 8 is the A4 size or the letter size.

The detection flag 302 and the photosensor 352 are arranged at positions at which the presence or absence of the sheet S of the A4 size cannot be detected and the presence or absence of the sheet S of the letter size larger than the sheet S of the A4 size can be detected. In this manner, the sheet S of the A4 size is not brought into contact with a contact surface 31A2 of the detection flag 302, and only the sheet S of the letter size is brought into contact therewith. The control unit 200 detects the presence or absence of the sheet S on the feeding tray 8 by using the detection flag 301 and the photosensor 351. When the presence of the sheet S is detected as a result of the detection, the control unit 200 determines the size of the sheet S by using the detection flag 302 and the photosensor 352. For example, when an on-signal input from the photosensor 351 and an off-signal input from the photosensor 352 are received, the control unit 200 determines that the sheet S has the A4 size. Further, when an on-signal input from the photosensor 351 and an on-signal input from the photosensor 352 are received, the control unit 200 determines that the sheet S has the letter size. The position of the photosensor 352 is appropriately set in accordance with the sizes of the sheets to be fed by the printer. Further, two or more photosensors 352 may be arranged as needed so as to detect the size of the sheets.

The control unit 200 detects the presence or absence of the sheet S on the feeding tray 8 by one of the plurality of sets of the detection flag 30 and the photosensor 35. When presence of the sheet S on the feeding tray 8 is detected, the control unit 200 detects the size of the sheet S which is stacked on the feeding tray 8 by using the remaining set of the detection flag 30 and the photosensor 35.

The control unit 200 controls the image forming unit 20 in accordance with the detected size of the sheet S. For example, the control unit 200 adjusts a bias voltage to be applied to the transfer roller 12 or adjusts a heating amount of the fixing device 14 for the sheet S in accordance with the size of the sheet S. In this manner, an appropriate image can be formed on the sheet S. Specifically, when the signals from the plurality of sets of the detection flag 30 and the photosensor 35 are input to the control unit 200, the control unit 200 can adjust the image forming unit 20 based on the input signals to improve quality of the image formed on the sheet.

In the second embodiment, the detection flags 301 and 302 are held at the second positions by the lowermost sheet S as in the first embodiment described above. Therefore, the detection flags 301 and 302 can be prevented from causing a resistance against conveyance of the sheet S to be fed. In this manner, the sheets S of various sizes can be stably fed.

Further, the detection flags 301 and 302 are only required to be arranged side by side in the width direction B. Therefore, a degree of freedom in installation is high. Further, the image forming apparatus can be prevented from being increased in size.

Third Embodiment

An image forming apparatus including a sheet feeding apparatus according to a third embodiment of the present invention is now described. In the first embodiment and the second embodiment described above, description is made of the image forming apparatus in which the sheet is supplied to the sheet feeding apparatus by manual feeding. However, in the third embodiment, description is made of an image forming apparatus in which a sheet is supplied to the sheet feeding apparatus by a feeding cassette being an example of a tray which is provided removably.

Figure 6A:
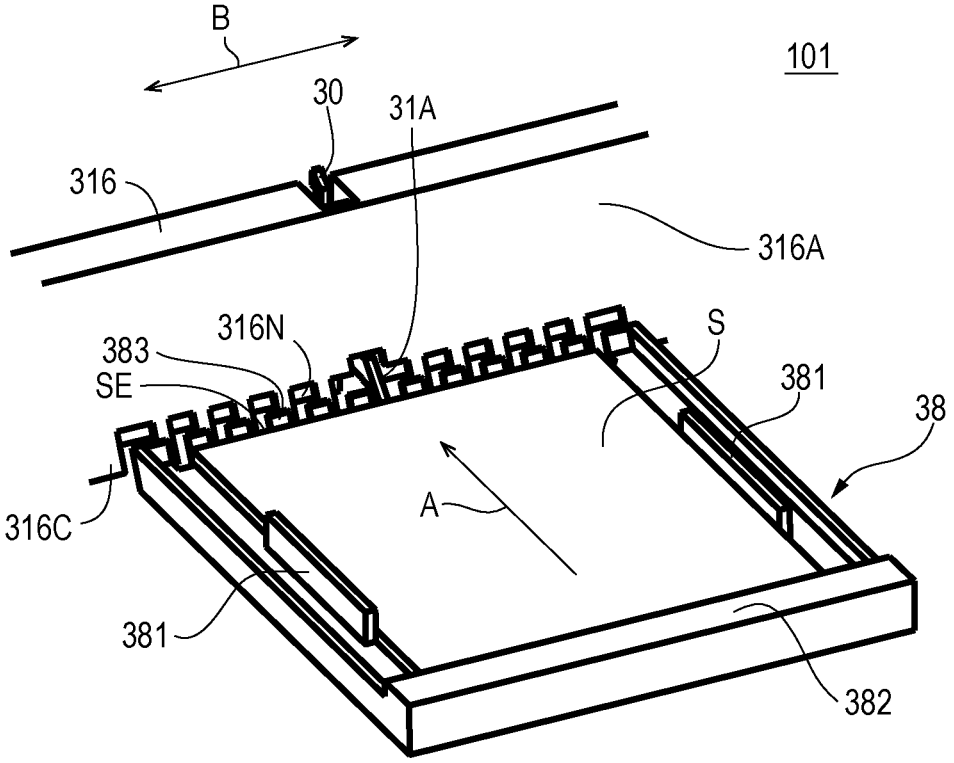
FIG. 6A is a perspective view of a main part of a sheet feeding apparatus in a printer as an example of an image forming apparatus according to a third embodiment of the present invention.
Figure 6B:
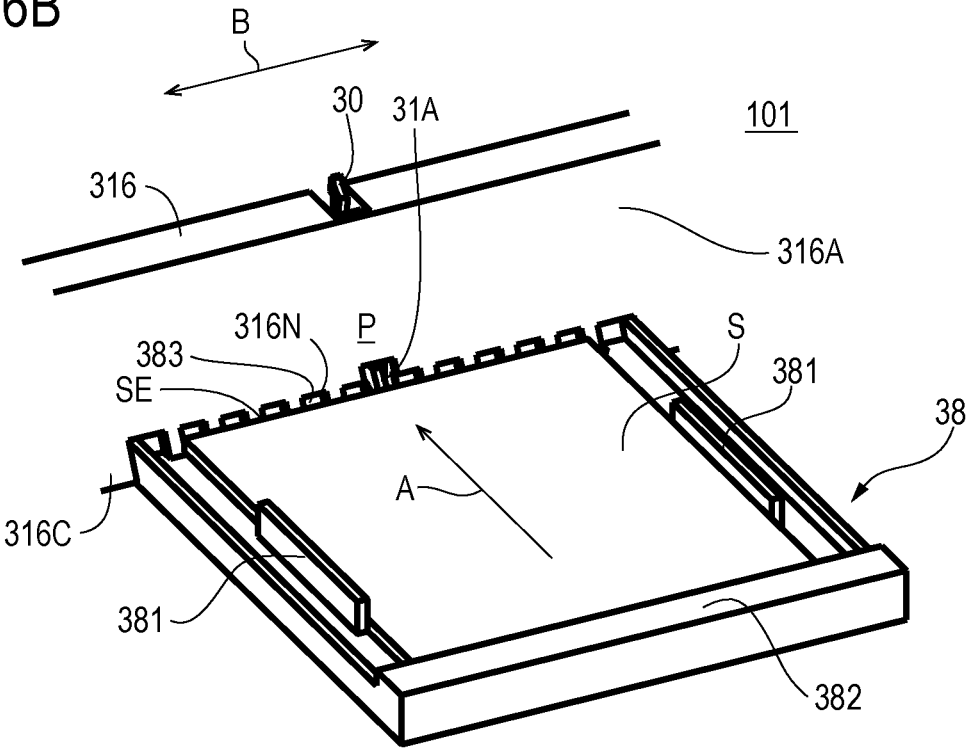
FIG. 6B is a perspective view of a main part of the sheet feeding apparatus in the printer according to the third embodiment of the present invention.
Figure 7A:
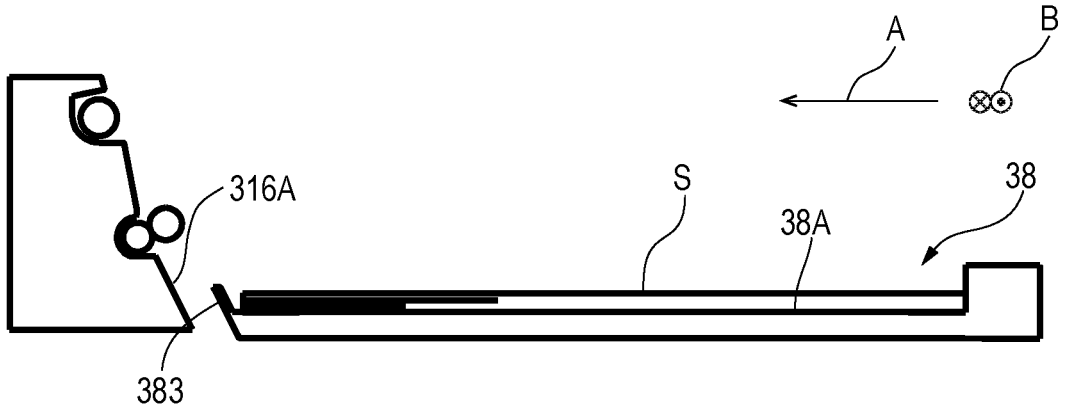
FIG. 7A is a sectional view of the main part of the sheet feeding apparatus in the printer according to the third embodiment of the present invention.
Figure 7B:
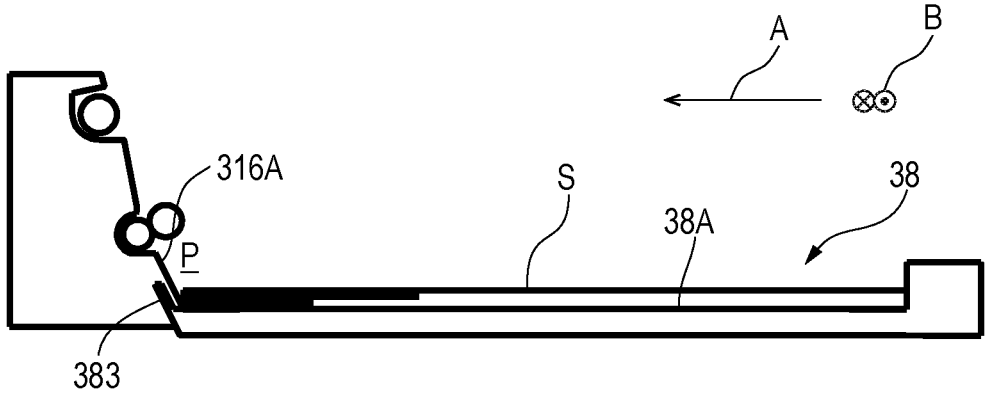
FIG. 7B is a sectional view of the main part of the sheet feeding apparatus in the printer according to the third embodiment of the present invention.

FIG. 6A is a perspective view of a main part of the sheet feeding apparatus under a state in which a feeding cassette 38 is drawn out from the apparatus main body 101, in a printer being an example of the image forming apparatus according to the third embodiment. FIG. 6B is a perspective view of the main part of the sheet feeding apparatus under a state in which the feeding cassette 38 is mounted to the apparatus main body 101, in the printer being an example of the image forming apparatus according to the third embodiment. FIG. 7A is a sectional view of the main part of the sheet feeding apparatus under the state in which the feeding cassette 38 is drawn out from the apparatus main body 101, in the printer according to the third embodiment. FIG. 7B is a sectional view of the main part of the sheet feeding apparatus under the state in which the feeding cassette 38 is mounted to the apparatus main body 101, in the printer according to the third embodiment.

The feeding cassette 38 is capable of storing the plurality of sheets S, and has a stacking surface 38A capable of receiving the sheet S to be stacked thereon. The feeding cassette 38 is removably mounted to the apparatus main body 101 from the front side. A direction of mounting the feeding cassette 38 is a direction along the sheet feeding direction A, whereas a direction of drawing out the feeding cassette 38 is a direction opposite to the direction of mounting the feeding cassette 38.

A wall portion 316 has a plurality of cutout portions 316N formed in a lower end portion 316C at intervals in the width direction B. Thus, the lower end portions 316C of the wall portion 316 has a comb-like shape. The feeding cassette 38 has a pair of side regulating portions 381 at both ends of the sheet S in the width direction B and a trailing edge regulating portion 382 at an upstream side end in the sheet feeding direction A, which form a positioning unit configured to position the sheet in the feeding cassette 38.

Further, the feeding cassette 38 has a plurality of insertion portions 383 formed on a front side portion in the direction of mounting the feeding cassette 38 into the apparatus main body 101, which are to be respectively inserted into the plurality of cutout portions 316N when the feeding cassette 38 is mounted to the apparatus main body 101. The insertion portions 383 correspond to a side wall portion opposed to the downstream side edge SE of the sheet S which is stored in the feeding cassette 38 and stacked on the stacking surface 38A. One insertion portion 383 formed on the feeding cassette 38 may be inserted into one cutout portion 316N formed in the wall portion 316. Alternatively, two or more insertion portions 383 may be inserted into one cutout portion 316N.

A positional relationship between the cutout portions 316N and the insertion portions 383 is set so that, when the feeding cassette 38 is mounted to the apparatus main body 101, the downstream side edge SE of the sheet S, which is positioned inside the feeding cassette 38 by the positioning unit, is brought into contact with the wall surface 316A of the wall portion 316. In this manner, the downstream side edge SE of the sheet S is brought into contact with the contact surface 31A of the detection flag 30 to move the detection flag 30. The contact surface 31A of the detection flag 30 is brought into contact with the downstream side edge SE of the sheet S through a space between one pair of insertion portions 383.

Each of the insertion portions 383 is formed so as to be inclined with respect to the stacking surface 38A. The plurality of insertion portions 383 forms the comb-like shape. Each of the insertion portions 383 is inserted into a corresponding one of the cutout portions 316N so as not to be positioned on the side of the conveyance path P through which the sheet S is conveyed. In this manner, the downstream side edge SE of the sheet S is positioned by the wall surface 316A formed on the apparatus main body 101.

When the feeding cassette 38 is drawn out from the apparatus main body 101, or no sheet S is left in the feeding cassette 38, the detection flag 30 is moved to the first position P1 (FIG. 2A and FIG. 2B) as in the first embodiment described above. Further, when the feeding cassette 38 is mounted to the apparatus main body 101 under a state in which the sheet S is stacked on the stacking surface 38A of the feeding cassette 38, the detection flag 30 is moved to the second position P2 (FIG. 3A and FIG. 3B) as in the first embodiment.

Therefore, also in the third embodiment, as in the first embodiment described above, the detection flag 30 is held at the second position P2 (FIG. 3A and FIG. 3B) by the lowermost sheet S1, and therefore can be prevented from causing a resistance against conveyance of the sheet S to be fed. Thus, the sheet S can be stably fed.

The present invention is not limited to the embodiments described above, and various modifications can be made within a scope of the technical idea of the present invention. Further, the effects described in the embodiments of the present invention are the most preferred effects obtained from the present invention, and the effects of the present invention are not limited to those described in the embodiments of the present invention.

In the embodiments described above, the detection flag 30 is urged toward the first position by its own weight, and is pushed by the sheet to be moved to the second position. However, the detection flag 30 may be urged toward the first position by an urging member such as a spring. In this case, an elastic force of the spring is set small to such a degree that a leading edge of the sheet is not damaged thereby.

Further, in the embodiments described above, the photosensor 35 being an example of the sensor unit is the photo-interrupter. However, the photosensor 35 may be a photo-reflector. Further, in the embodiments described above, the sensor unit is the photosensor 35. However, the sensor unit may be a sensor other than the photosensor as long as the position of the moving member can be detected. Further, in the embodiments described above, the moving member is the swingable detection flag 30. However, the moving member is not limited thereto, and may be, for example, a linearly movable member. For example, the detection flag may be supported slidably by a slide guide or other components so that the sensor is turned on or off when the detection flag is pushed by the sheet to be moved in a sliding manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-103017, filed May 24, 2017, which is hereby incorporated by reference herein in its entirety.

What is claimed is:

1. A sheet feeding apparatus comprising:

a stacking device having a stacking surface on which a plurality of sheets is to be stacked;

a feeding device configured to feed each of the plurality of the sheets stacked on the stacking surface;

a contact portion including a first surface, a downstream side edge of each of the plurality of sheets with respect to a sheet feeding direction of the sheets stacked on the stacking device being brought into contact with the first surface, wherein the first surface includes a surface inclined with respect to the stacking surface, and an angle formed between the first surface and the stacking surface being an obtuse angle;

a moving member having a contact surface, the downstream side edge of each of the plurality of sheets fed by the feeding device being brought into contact with the contact surface, wherein the contact surface is movable so that a protruding amount of the contact surface from the first surface changes, and a sensor unit configured to output a signal according to the position of the moving member, wherein a position of the moving member under a state in which at least one of the sheets is stacked on the stacking surface for feeding the sheet by the feeding device is defined as a retreat position, the at least one sheet stacked on the stacking device moving the moving member to the retreat position to change the signal of the sensor unit, and wherein the feeding device brings leading edges of the plurality of sheets into contact with the first surface so as to separate one sheet from the plurality of the sheets.

2. A sheet feeding apparatus according to claim 1, wherein an angle formed between the contact surface and the stacking surface is greater than the angle formed between the first surface and the stacking surface under a state in which the moving member is located in the retreat position.

3. A sheet feeding apparatus according to claim 2, wherein in the second position of the moving member, the downstream side edge of any one of the plurality of sheets stacked on the stacking surface is brought into contact with both the contact surface and the first surface.

4. A sheet feeding apparatus according to claim 1, further comprising an apparatus main body in which the feeding device is to be arranged, wherein the stacking device includes a tray to be fixed with respect to the apparatus main body.

5. A sheet feeding apparatus according to claim 1, further comprising an apparatus main body in which the feeding device is to be arranged, wherein the stacking device includes a tray mountable into and removable from the apparatus main body and capable of storing the sheets therein.

6. A sheet stacking apparatus according to claim 5, wherein the contact portion has a plurality of cutout portions, and wherein the tray has a plurality of insertion portions arranged on a downstream side of the plurality of sheets to be contained therein, the plurality of insertion portions being inserted into the plurality of cutout portions when the tray is mounted to the apparatus main body.

7. An image forming apparatus comprising:

a sheet feeding apparatus according to claim 1; and an image forming unit configured to form an image on the plurality of sheets fed by the sheet feeding apparatus.

8. An image forming apparatus according to claim 7, wherein the image forming unit includes:

an image bearing member configured to bear a toner image thereon;

a transfer unit forming a transfer nip in cooperation with the image bearing member, the transfer unit configured to transfer the toner image onto the sheets at the transfer nip; and a fixing unit configured to fix the toner image transferred onto the sheets at the transfer unit onto the sheets, wherein the transfer unit and the fixing unit are arranged in the listed order along a conveyance path for the sheets, the conveyance path extending upward from the sheet feeding apparatus, and wherein the sensor unit is arranged above the transfer nip.

9. A sheet feeding apparatus comprising:

a stacking device having a stacking surface on which a plurality of sheets is to be stacked;

a feeding device configured to feed each of the plurality of sheets stacked on the stacking surface;

a contact portion including a first surface, a downstream side edge of each of the plurality of sheets with respect to a sheet feeding direction of the sheets stacked on the stacking device being brought into contact with the first surface, wherein the first surface includes a surface inclined with respect to the stacking surface, and an angle formed between the first surface and the stacking surface being an obtuse angle; and a moving member having a contact surface, the downstream side edge of each of the plurality of sheets fed by the feeding device being brought into contact with the contact surface, wherein the contact surface is movable so that a protruding amount of the contact surface from the first surface changes, wherein in a case in which a position of the moving member under a state in which the sheets are not stacked on the stacking surface is defined as a first position, and a position of the moving member under a state in which the sheets are present on the stacking surface so as to be fed by the feeding device is defined as a second position, the moving member is supported swingably by a supporting unit arranged on a side opposite to the stacking device with respect to the contact portion, the supporting unit being urged toward the first position by its own weight.

10. A sheet feeding apparatus comprising:

a stacking device having a stacking surface on which a plurality of sheets is to be stacked;

a separation tilt surface arranged so that an angle formed between the separation tilt surface and the stacking surface of the stacking device is set to an obtuse angle;

a feeding device swingably supported above the stacking surface, the feeding device being brought into contact with the sheets stacked on the stacking surface to feed the sheets toward the separation tilt surface;

a moving member having a contact surface with which the sheets stacked on the stacking surface are brought into contact, the contact surface protruding from the separation tilt surface so as to traverse a position at which a plane including the stacking surface and a plane including the separation tilt surface intersect with each other;

a sensor unit configured to output a signal according to a position of the moving member; and a control unit configured to detect presence or absence of the sheets stacked on the stacking surface of the stacking device based on reception of the signal input from the sensor unit.

11. A sheet feeding apparatus according to claim 10, wherein the moving member is swingably supported by a supporting unit arranged on a side opposite to the stacking device with respect to the separation tilt surface, and the moving member is urged so that a lower end side of the contact surface of the moving member protrudes from the separation tilt surface by a predetermined amount.

12. A sheet feeding apparatus according to claim 10, wherein an angle formed between the contact surface of the moving member and the stacking surface is greater than an angle formed between the separation tilt surface and the stacking surface within a movable range in which the moving member is movable.

13. A sheet feeding apparatus according to claim 10, wherein a lower end side of the moving member passes through an opening port formed in the separation tilt surface to protrude from the separation tilt surface.

14. A sheet feeding apparatus according to claim 10, further comprising a control unit configured to detect a size of the sheets stacked on the stacking surface of the stacking device based on reception of the signal output from the sensor unit.

* * * * *